US007649317B2

(12) United States Patent
Choi et al.

(10) Patent No.: US 7,649,317 B2
(45) Date of Patent: Jan. 19, 2010

(54) PLASMA DISPLAY PANEL WITH AN IMPROVED ELECTRODE STRUCTURE

(75) Inventors: Hoon-Young Choi, Suwon-si (KR); Min Hur, Suwon-si (KR); Young-Do Choi, Suwon-si (KR); Yon-Goo Park, Suwon-si (KR)

(73) Assignee: Samsung SDI Co., Ltd., Suwon-Si, Gyeonggi-do (KR)

( * ) Notice: Subject to any disclaimer, the term of this patent is extended or adjusted under 35 U.S.C. 154(b) by 420 days.

(21) Appl. No.: 11/268,039

(22) Filed: Nov. 7, 2005

(65) Prior Publication Data

US 2006/0108924 A1 May 25, 2006

(30) Foreign Application Priority Data

Nov. 23, 2004 (KR) ..... 10-2004-0096216

(51) Int. Cl.
*H01J 17/49* (2006.01)

(52) U.S. Cl. ..... 313/584; 313/582; 313/585; 313/587; 345/37; 345/41; 345/60

(58) Field of Classification Search ..... 313/582–587
See application file for complete search history.

(56) References Cited

U.S. PATENT DOCUMENTS

| | | | | |
|---|---|---|---|---|
| 6,479,932 | B1 * | 11/2002 | Nunomura | 313/582 |
| 6,531,819 | B1 * | 3/2003 | Nakahara et al. | 313/584 |
| 6,624,591 | B2 * | 9/2003 | Mori et al. | 315/169.3 |
| 6,838,826 | B2 * | 1/2005 | Lin et al. | 313/582 |
| 7,235,925 | B2 * | 6/2007 | Kwon et al. | 313/583 |
| 2004/0189201 | A1 * | 9/2004 | Kang et al. | 313/584 |
| 2005/0285529 | A1 * | 12/2005 | Hwang et al. | 313/584 |

FOREIGN PATENT DOCUMENTS

| | | | |
|---|---|---|---|
| CN | 1532875 | A1 | 9/2004 |
| JP | 11-238462 | | 8/1999 |
| JP | 2000251739 | A | 9/2000 |
| JP | 2000-294149 | A | 10/2000 |
| JP | 2002075214 | A | 3/2002 |
| JP | 2002-298742 | | 10/2002 |
| JP | 2004296442 | A | 10/2004 |
| JP | 2005-302723 | A | 10/2005 |
| KR | 19990033201 | * | 5/1999 |
| KR | 1020040103994 | A | 12/2004 |
| KR | 1020050096994 | A | 10/2005 |

* cited by examiner

*Primary Examiner*—Sikha Roy
(74) *Attorney, Agent, or Firm*—Knobbe Martens Olson & Bear LLP

(57) ABSTRACT

A plasma display device having an improved electrode structure that is capable of improving a contrast of the plasma display panel while decreasing a discharge firing voltage is provided. A plasma display panel according to an embodiment of the invention includes first and second substrates disposed opposite to each other, barrier ribs arranged in a space between the first substrate and the second substrate to define at least one discharge cell, address electrodes formed along a first direction, and display electrodes formed along a second direction intersecting the first direction. The display electrodes include bus electrodes formed extending in the second direction, expansion electrodes that extend toward the center of each discharge cell from the bus electrodes and face each other in the discharge cell with a discharge gap interposed therebetween, and auxiliary electrodes located at front ends of the expansion electrodes opposite to each other.

18 Claims, 7 Drawing Sheets

PLASMA DISPLAY PANEL WITH AN IMPROVED ELECTRODE STRUCTURE

CROSS-REFERENCE TO RELATED APPLICATION

This application claims priority to and the benefit of Korean Patent Application No. 10-2004-0096216 filed in the Korean Intellectual Property Office on Nov. 23, 2004, the entire content of which is incorporated herein by reference.

BACKGROUND OF THE INVENTION

1. Technical Field

The present invention relates to a plasma display panel, and more particularly, to a plasma display panel having an improved electrode structure.

2. Discussion of Related Technologies

Generally, a plasma display panel (hereinafter, referred to as a PDP) is a display device in which vacuum ultraviolet rays (VUV) emitted from plasma generated by gas discharge excite phosphors to emit visible light, thereby forming predetermined images.

The PDP can be manufactured as a large-size screen of more than 60 inches diagonal with a thickness of less than 10 cm. Because it is a self-emitting display device, like a cathode ray tube display, there is no distortion due to viewing angle and it has outstanding color reproduction. Moreover, its manufacturing process is simpler than that of a liquid crystal display device, so that the PDP has advantages in manufacturability and cost. Accordingly, the PDPs have been touted as a next generation flat panel display and television for industrial purposes.

PDPs have been under development since 1970. Generally, a three-electrode surface discharge structure has been used. According to the three-electrode surface discharge structure, a PDP is composed of a front substrate where display electrodes are formed on the same plane and a rear substrate which is a predetermined distance away from the front substrate and where address electrodes are formed. Discharge gases are disposed between the front substrate and the rear substrate.

An address discharge between one of the display electrodes and the address electrode selects a discharge cell. A sustain discharge between the display electrodes generates a plasma, which ultimately generates visible light, as discussed above.

Currently, each display electrode generally comprises an expansion electrode and a metal electrode. The expansion electrodes are positioned opposite to each other in each discharge cell to form a discharge gap.

However, these expansion electrodes do not have high electrical conductivity, resulting in high discharge firing voltages.

In addition, it has been reported that ambient light reflected from the front substrate of the PDP decreases the contrast in the PDP.

SUMMARY OF CERTAIN INVENTIVE ASPECTS

An advantage of the present invention is that it provides a plasma display panel having an improved electrode structure capable of improving the display's contrast while reducing the discharge firing voltage.

According to an aspect of the invention, there is provided a plasma display panel comprising a first substrate and second substrates disposed opposite to each other, a plurality of barrier ribs disposed between the first substrate and the second substrate, wherein the barrier ribs define at least one discharge cell, an address electrodes formed along a first direction, and a plurality of display electrodes formed along a second direction, wherein the second direction intersects the first direction. A pair of the display electrodes are disposed above the at least one discharge cell with a discharge gap interposed therebetween. Each display electrode comprises a bus electrode extending along the second direction, an expansion electrode comprising a front end and a back end, wherein the back end is proximal to the bus electrode and the front end extends towards the other display electrode. An auxiliary electrode disposed at or near the front end of the expansion electrode.

Preferably, each display electrode comprises a plurality of auxiliary electrodes in the discharge cell, wherein the auxiliary electrodes are located at or near the front ends of the expansion electrodes, the auxiliary electrodes are spaced apart from each other at a predetermined gap.

Preferably, the auxiliary electrodes are formed at locations away from central portions of each discharge cells. Preferably, the auxiliary electrodes, formed at or near the front ends of the pair of expansion electrodes in the discharge cell oppose each other with a discharge gap interposed therebetween.

Preferably, the auxiliary electrodes are positioned away from the bus electrodes.

Preferably, the barrier ribs have barrier rib members formed in the first direction, and the auxiliary electrodes are formed close to the barrier rib members.

Preferably, each display electrode comprises a plurality of expansion electrodes are dimensioned and configured to correspond to the respective discharge cells, and the auxiliary electrodes extend from the expansion electrodes away from the edges of the expansion electrodes in the second direction.

Preferably, each auxiliary electrode is wider in the second direction than in the first direction.

Preferably, each auxiliary electrode has a first portion formed along the front end of the expansion electrode in the second direction and a second portion extending from the first portion in the first direction.

Preferably, each auxiliary electrode is directly connected to the bus electrode. Preferably, each auxiliary electrode includes a first portion extending along the front end of the expansion electrode in the second direction, and a second portion which extends from the first portion in the first direction to the bus electrode.

BRIEF DESCRIPTION OF THE DRAWINGS

These and/or other aspects and advantages of the invention will become apparent and more readily appreciated from the following description of the embodiments, taken in conjunction with the accompanying drawings, in which.

DETAILED DESCRIPTION OF EMBODIMENTS

Hereinafter, preferred embodiments of the invention will be described in detail with reference to the accompanying drawings so as to be appreciated by those skilled in the art. However, various changes and modifications can be made in the invention, and the invention is not limited to the preferred embodiments.

Figure 1:
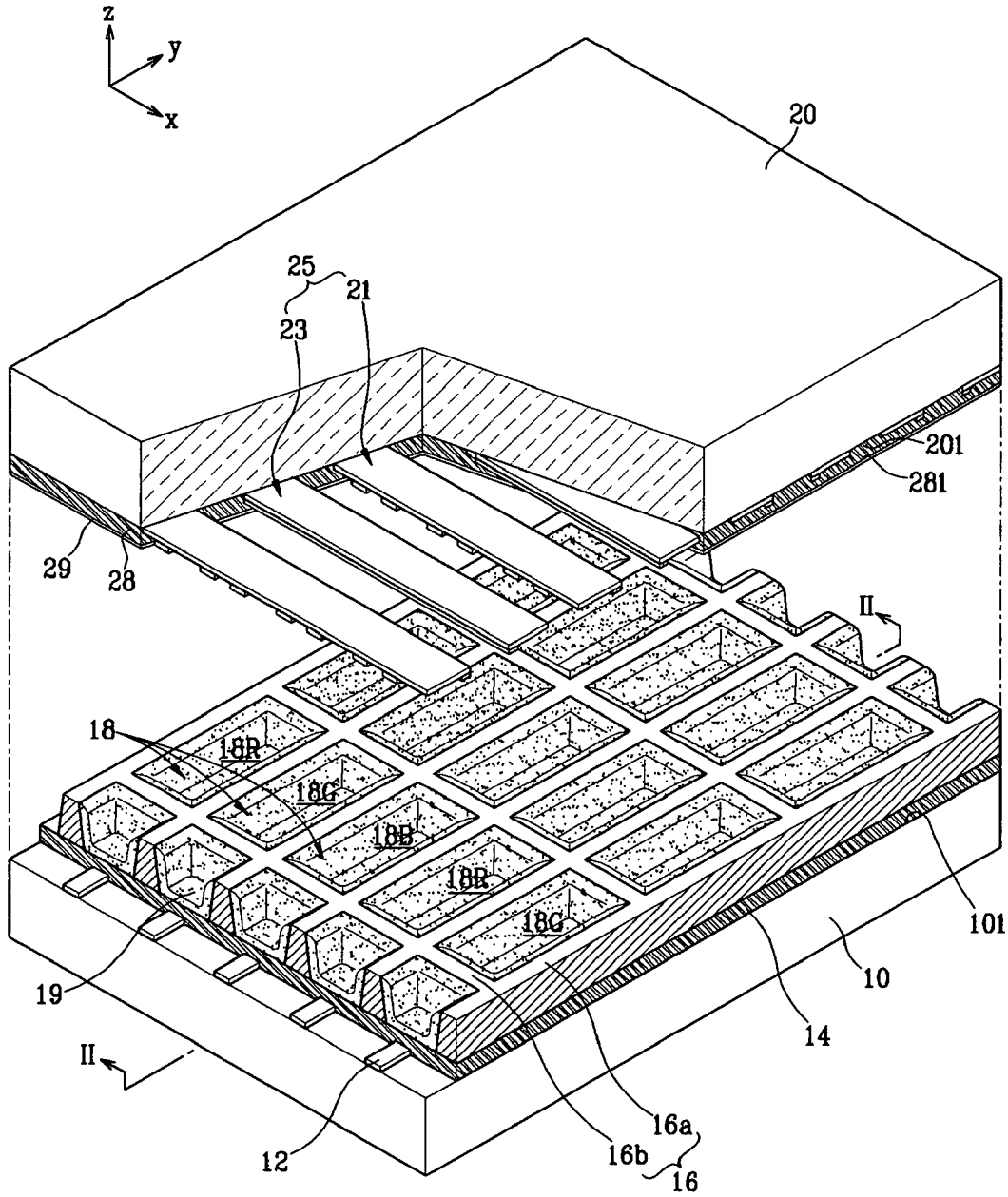
FIG. 1 is a partial exploded perspective view of a plasma display panel according to a first embodiment of the invention.
Figure 2:
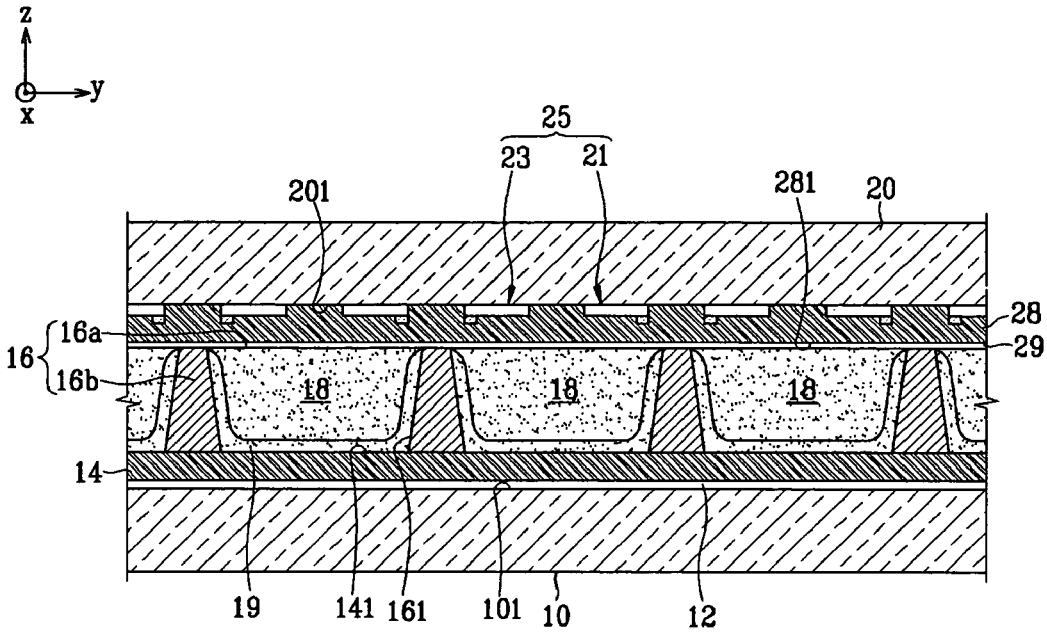
FIG. 2 is a partial cross-sectional view taken along the line II-II of FIG. 1.

FIG. 1 is a partial exploded perspective view of a plasma display panel according to a first embodiment of the invention and FIG. 2 is a partial cross-sectional view taken along the line II-II of FIG. 1.

Referring to FIGS. 1 and 2, in the plasma display panel (PDP) according to the first embodiment of the invention, a first substrate 10 (hereinafter, referred to as a rear substrate) and a second substrate 20 (hereinafter, referred to as a front substrate) are disposed opposite to each other with a predetermined gap, and the space between the substrates 10 and 20 is divided into at least one discharge cell 18 by barrier ribs 16. In addition, a phosphor layer 19, which is excitable by ultraviolet rays to emit visible light, is formed in each discharge cell 18, and each discharge cell 18 is filled with discharge gas so as to generate plasma discharge.

Specifically, address electrodes 12 are formed in a first direction (y-axis direction in the drawings) on a top surface 101 of the rear substrate 10 opposite to the front substrate 20, and are spaced apart from each other by a predetermined distance. These address electrodes 12 are covered with a dielectric layer 14 and the barrier ribs 16 are formed on the dielectric layer 14 in a predetermined pattern.

The barrier ribs 16 partition the discharge cells 18 to prevent crosstalk from occurring between adjacent discharge cells 18. In the present embodiment, the barrier ribs 16 have a closed structure which includes first barrier rib members 16*a* formed in the first (y-) direction and second barrier rib members 16*b* formed on the same plane together with the first barrier rib members 16*a* in a second direction (x-axis direction in the drawings) intersecting the first (y-) direction. However, the invention is not limited to this barrier rib structure and may use a stripe-type barrier rib structure, in which barrier rib members are formed in a first (y-) direction, as well as various other barrier rib structures.

Further, the phosphor layer 19, which is excited by ultraviolet rays generated at the time of discharging to emit visible light, is formed in each discharge cell 18. As shown in the drawings, the phosphor layers 19 are formed over the top surface 141 of the dielectric layer 14 and the side surfaces 161 of the barrier ribs 16. The phosphor layer 19 can be selectively formed of any one of a red phosphor layer, a green phosphor layer, and a blue phosphor layer in order to implement color display. Therefore, in some embodiments, the discharge cells 18 can be divided into red, green, and blue discharge cells (18R, 18G, and 18B). In some embodiments, the discharge cell 18, in which the phosphor layer 19 is disposed, is filled with a mixed discharge gas of Ne and Xe.

The front substrate 20 is formed of a transparent material, such as glass, so that visible rays can be transmitted through it. Display electrodes 25 are formed on a bottom surface 201 of the front substrate 20 in the second (x-) direction such that they correspond to the respective discharge cells 18. Each display electrode 25 has a scan electrode 21 and a sustain electrode 23. The scan electrodes 21 and the sustain electrodes 23 are formed so as to correspond to respective discharge cells 18.

Discharge in the discharge cell 18 is initiated by an address discharge generated between a scan electrode 21 and an address electrode 12, thereby selecting the discharge cell. A predetermined display can be generated by a sustain discharge between the sustain electrode 23 and the scan electrode 21.

The display electrodes 25 will now be described below.

The display electrodes 25 are covered with a dielectric layer 28 formed of a dielectric, such as PbO, $B_2O_3$, and/or $SiO_2$. The dielectric layer 28 prevents charged particles from directly contacting the display electrodes 25 during discharge, thereby protecting the display electrodes 25 from damage. The dielectric layer 28 also serves to induce production of charged particles.

A bottom surface 281 of the dielectric layer 28 is covered with a protective film 29 formed of MgO or the like. The protective film 29 prevents charged particles from directly contacting the dielectric layer 28 during discharge, thereby protecting the dielectric layer 28 from damage. When the charged particles collide with the dielectric layer 28, the protective film 29 allows secondary electrons to be emitted, and thus serves to improve discharge efficiency.

The above-mentioned display electrodes 25 will now be described in detail with reference to FIGS. 3 and 4.

Figure 3:
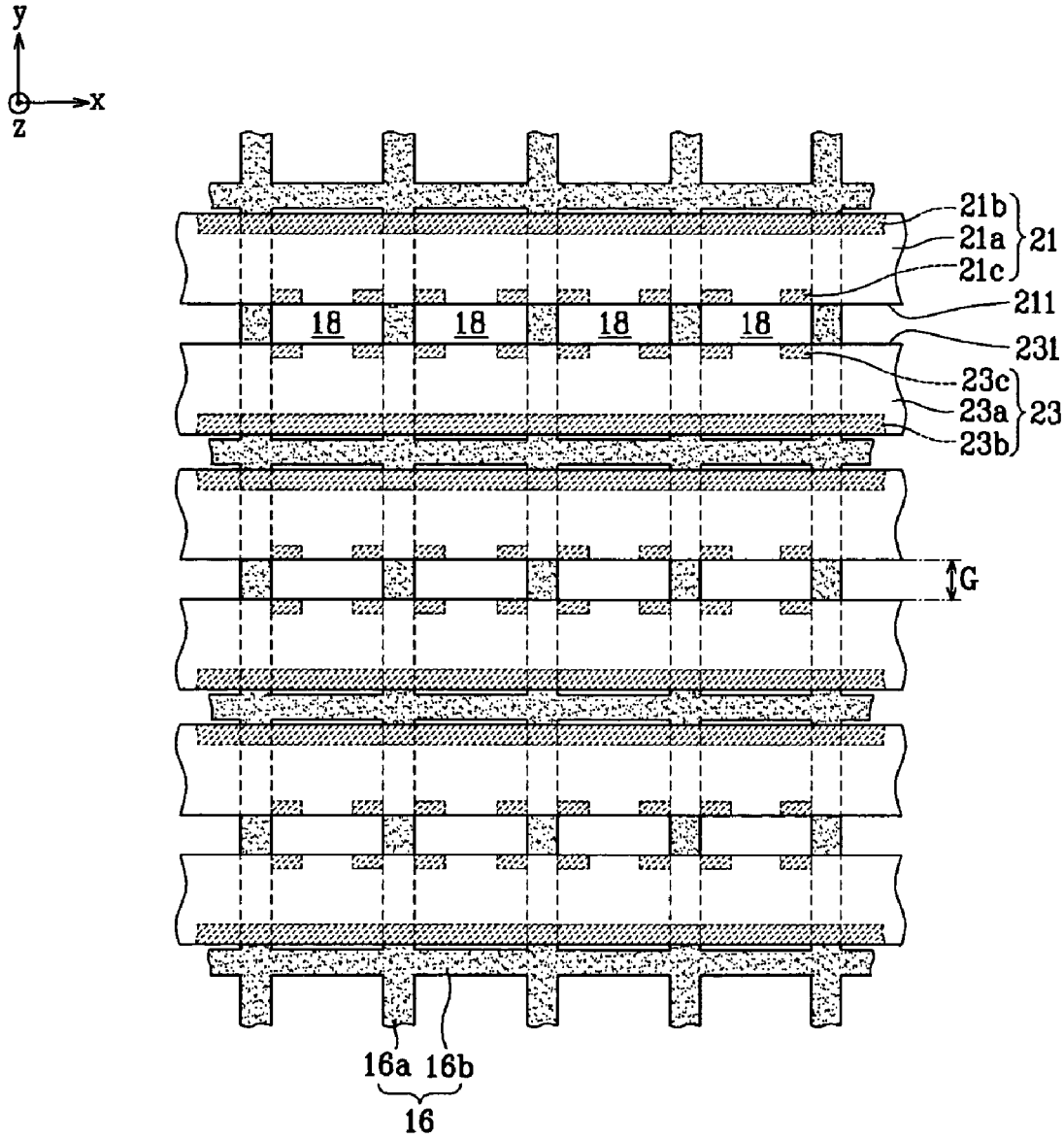
FIG. 3 is a partial plan view showing the plasma display panel according to the first embodiment of the invention.
Figure 4:
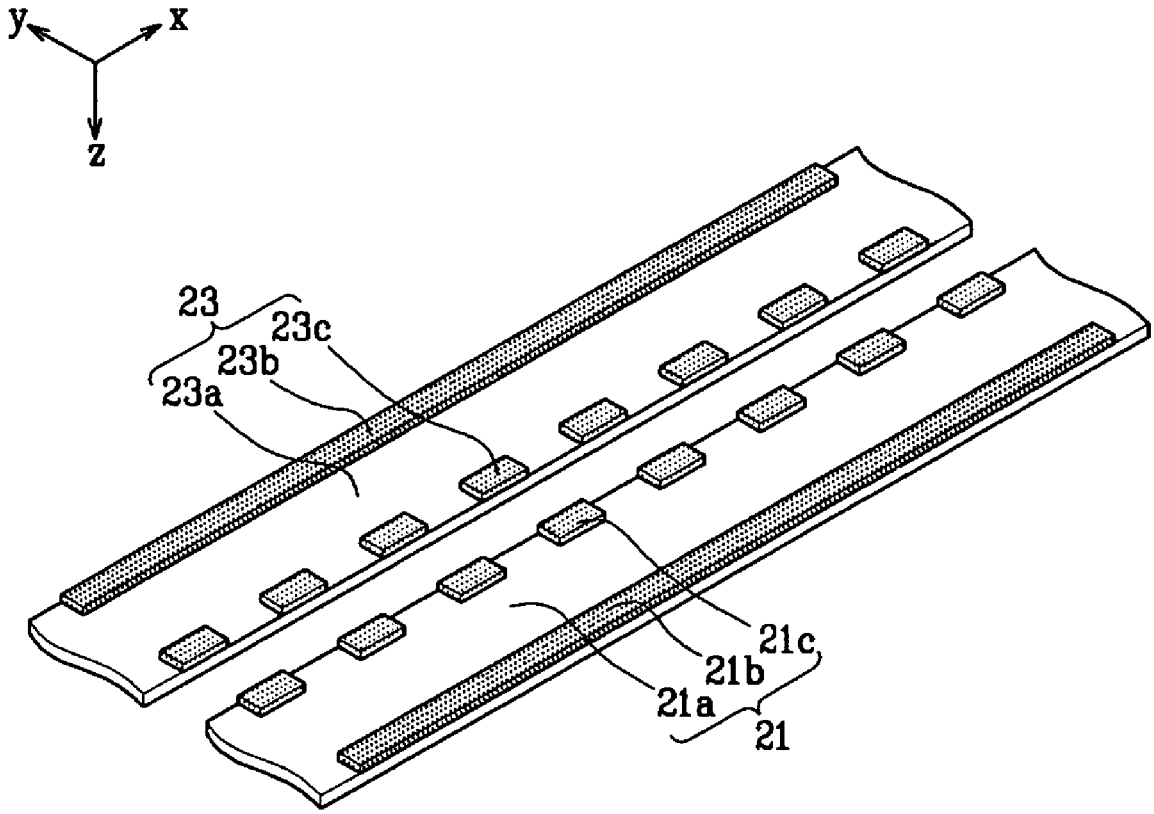
FIG. 4 is a partial perspective view showing a display electrode corresponding to each discharge cell in the first embodiment of the invention.

FIG. 3 is a partial plan view showing the plasma display panel according to the first embodiment of the invention, and FIG. 4 is a partial perspective view showing display electrodes corresponding to respective discharge cells in the first embodiment of the invention.

In the present embodiment, the scan electrodes 21 and the sustain electrodes 23 include bus electrodes 21*b* and 23*b* extending in the second (x-) direction on both sides of each discharge cell 18, expansion electrodes 21*a* and 23*a* extend toward the inside of each discharge cell 18 from the bus electrodes 21*b* and 23*b*, and auxiliary electrodes 21*c* and 23*c* formed at front ends 211 and 231 of the expansion electrodes 21*a* and 23*a*. The expansion electrodes 21*a* of the scan electrodes 21 and the expansion electrodes 23*a* of the sustain electrodes 23 are formed opposite to each other in the discharge cells 18, and the auxiliary electrodes 21*c* and 23*c*, which are formed at the front ends 211 and 231 of the expansion electrodes 21*a* and 23*a* opposite to each other, are formed opposite to each other with a discharge gap G interposed therebetween.

The expansion electrodes 21*a* and 23*a* are made of a light transmitting material, for example, ITO (indium tin oxide), such that visible light generated through the plasma discharge can be transmitted through them. In addition, the bus electrodes 21*b* and 23*b* and the auxiliary electrodes 21*c* and 23*c* can be made of a non-transparent metallic material capable of compensating for electrical conductivity of the expansion electrodes 21*a* and 23*a*, for example, any one of chromium, copper, silver, or the like. In some embodiments, the bus electrodes 21*b* and 23*b* and the auxiliary electrodes 21*c* and 23*c* can be made of the same material.

In the present embodiment, the expansion electrodes 21*a* and 23*a* strips elongated in the second (x-) direction. However, the invention is not limited to this configuration, and the expansion electrodes may have various configurations. The front end 211 of the expansion electrode 21*a* of the scan electrode 21 and the front end 231 of the expansion electrode 23*a* of the sustain electrode 23 oppose each other, and form a discharge gap G in the discharge cells 18.

In addition, in the present embodiment, the auxiliary electrodes 21*c* and 23*c*, which are formed at the front ends 211 and 231 of the expansion electrodes 21*a* and 23*a* in the discharge cells 18, are dimensioned and configured such that they are spaced apart from the bus electrodes 21*b* and 23*b*. In addition, the plurality of auxiliary electrodes 21*c*, which are formed on the scan electrodes 21, are spaced apart from each other by a predetermined gap. Similarly, the plurality of auxiliary electrodes 23*c*, which are formed in the sustain electrodes 23, are spaced apart from each other by a predetermined gap. In the illustrated embodiment, each auxiliary electrode 21*c* on the scan electrode 21 opposes an auxiliary electrode 23*c* on the sustain electrode 23 in the same discharge cell 18.

In addition, in the illustrated embodiment, the auxiliary electrodes 21*c* and 23*c* are formed close to a pair of first barrier rib members 16*a* defining the sides of each discharge cell 18. That is, the auxiliary electrodes 21*c* and 23*c* are formed at locations away from a central portion of each discharge cell 18 and do no block visible light emitted from the central portion of the discharge cell 18, which has the highest intensity of light. In addition, since these auxiliary electrodes 21*c* and 23*c* are made of a non-transmitting material as described above, they can prevent ambient light from reflecting.

Accordingly, according to the present embodiment, the visible light, which is emitted from the central portion of the discharge cell 18, is not blocked, so that the luminance from the discharge cell 18 can be sustained, and the contrast can be improved by suppressing the ambient light from reflecting.

In addition, by using the auxiliary electrodes 21*c* and 23*c* made of metallic electrodes having superior electrical conductivity, it is possible to compensate for poorer conductivity of the expansion electrodes 21*a* and 23*a* around the discharge gap G where the discharge starts, thereby decreasing a discharge firing voltage.

In the illustrated embodiment, in each of the auxiliary electrodes 21*c* and 23*c*, a width measured in the second (x-) direction is greater than a width measured in the first (y-) direction. Therefore, overlap areas of the auxiliary electrodes 21*c* and 23*c* opposite to each other in each discharge cell 18 are increased, thereby permitting a further decrease in the discharge firing voltage.

Hereinafter, a modification of the first embodiment of the invention and second and third embodiments will be described in detail. Since the modification and embodiments have a structure similar to that of the first embodiment, only the differences will be described in detail.

Figure 5:
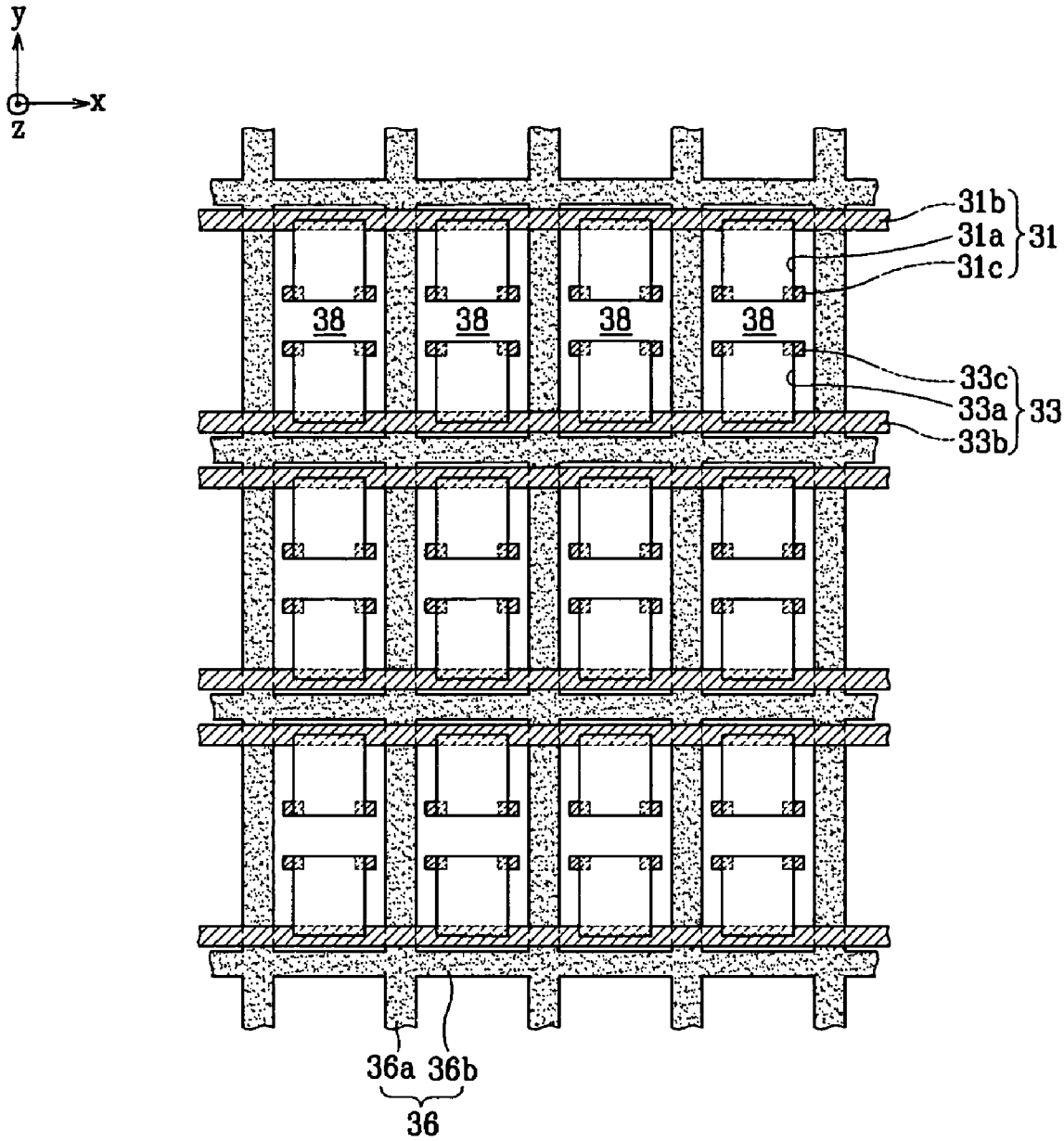
FIG. 5 is a partial plan view showing a modification of the first embodiment of the invention.

FIG. 5 is a partial plan view showing the modification of the first embodiment of the invention.

In the modification, scan electrodes 31 and sustain electrodes 33 include expansion electrodes 31*a* and 33*a*, bus electrodes 31*b* and 33*b*, and auxiliary electrodes 31*c* and 33*c*, as in the first embodiment.

In the illustrated embodiment, as shown in FIG. 5, a plurality of expansion electrodes 31*a* and 33*a* are formed, each corresponding to a discharge cell 38 defined by barrier ribs 36. In addition, the auxiliary electrodes 31*c* and 33*c* extend toward the first barrier rib members 36*a* from front ends of the expansion electrodes 31*a* and 33*a*. That is, the auxiliary electrodes 31*c* and 33*c* extend both away from the edges of the expansion electrodes 31*a* and 33*a*, and 33*a* away from the central portion of the discharge cell 38. In the modification, a reference numeral 36*b*, which is not described in the modification, indicates a second barrier rib member.

In the present modification, since the auxiliary electrodes 31*c* and 33*c* are formed at the front ends of the expansion electrodes 31*a* and 33*a*, a discharge firing voltage of the sustain discharge can be reduced while improving a contrast.

Figure 6:
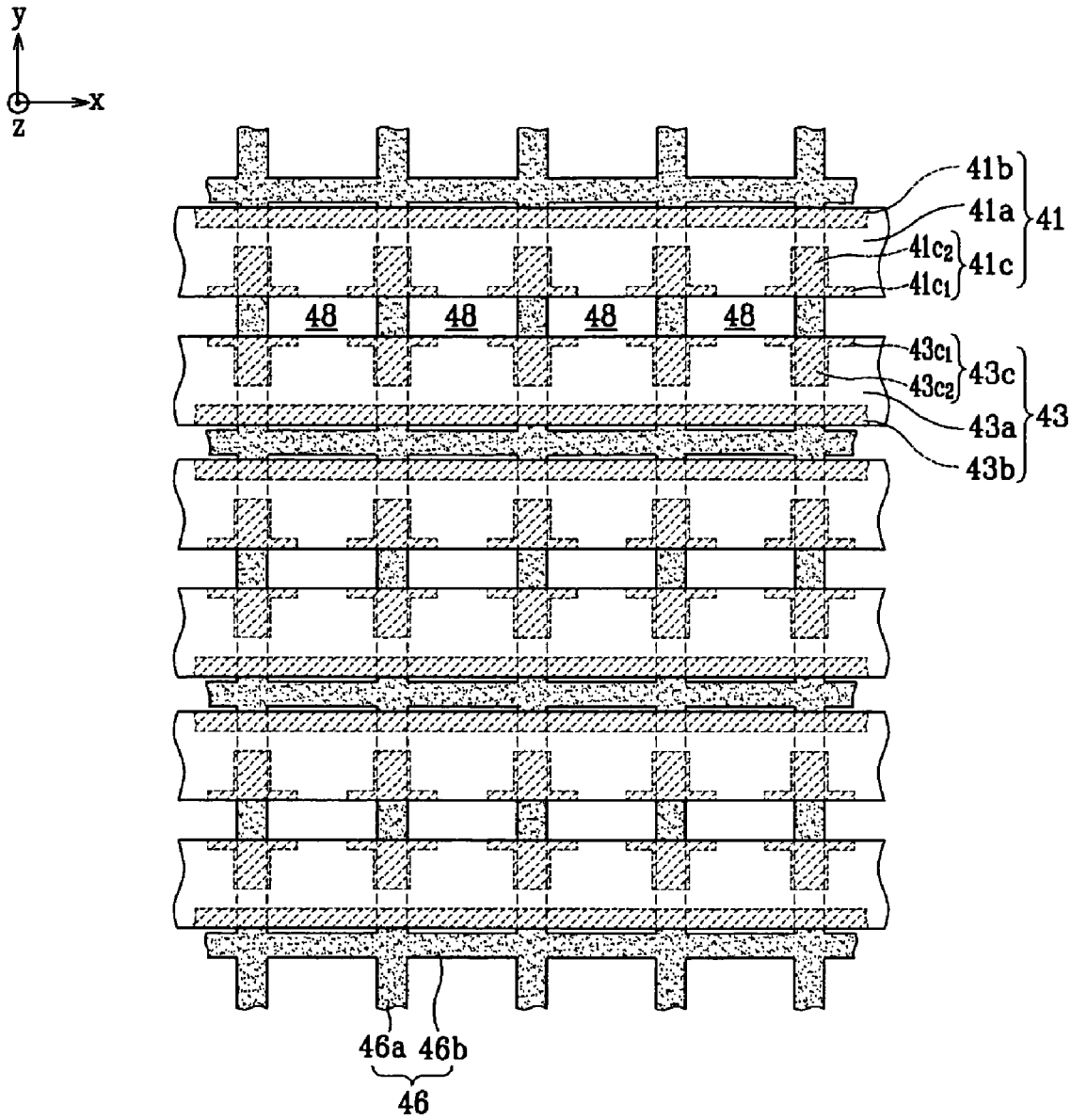
FIG. 6 is a partial plan view showing a plasma display panel according to a second embodiment of the invention.

FIG. 6 is a partial plan view showing a plasma display panel according to a second embodiment of the invention.

In the second embodiment, scan electrodes 41 and sustain electrodes 43 include expansion electrodes 41*a* and 43*a*, bus electrodes 41*b* and 43*b*, and auxiliary electrodes 41*c* and 43*c* each having particular dimensions and configurations. Referring to FIG. 6, the auxiliary electrodes 41*c* and 43*c* include first portions $\mathbf{41}c_1$ and $\mathbf{43}c_1$ formed over the discharge cells 48 adjacent to front ends of the expansion electrodes 41*a* and 43*a* in the second (x-) direction, and second portions $\mathbf{41}c_2$ and $\mathbf{43}c_2$ extending from the first portions $\mathbf{41}c_1$ and $\mathbf{43}c_1$ in the first (y-) direction.

In the present embodiment, each of the barrier ribs 46 defining the respective discharge cells 48 has a first barrier rib member 46*a* formed in a first direction and a second barrier rib member 46*b* formed in a second direction. The second portions $\mathbf{41}c_2$ and $\mathbf{43}c_2$ of the auxiliary electrodes 41*c* and 43*c* are formed to substantially overlap the first barrier rib members 46*a*. In addition, line widths of the second portions $\mathbf{41}c_2$ and $\mathbf{43}c_2$ of the auxiliary electrodes 41*c* and 43*c* may be equal to or greater than those of the first barrier rib member 46*a*.

In addition, in the first portions $\mathbf{41}c_1$ and $\mathbf{43}c_1$ of the auxiliary electrodes 41*c* and 43*c*, widths measured in the second (x-) direction may be greater than those measured in the first (y-) direction. Therefore, it is possible to increase overlap areas of the auxiliary electrodes 41*c* and 43*c* opposite to each other in each discharge cell 48. Furthermore, in the illustrated embodiment, the first portions $\mathbf{41}c_1$ and $\mathbf{43}c_1$ of the auxiliary electrodes 41*c* and 43*c* extend between discharge cells 48 that are adjacent in the second (x-) direction.

In the present embodiment, the auxiliary electrodes 41*c* and 43*c* made of the non-transparent conducive materials are formed at the front ends of the expansion electrodes 41*a* and 43*a*, thereby permitting reduction of the discharge firing voltage of the sustain discharge, while improving the contrast.

Figure 7:
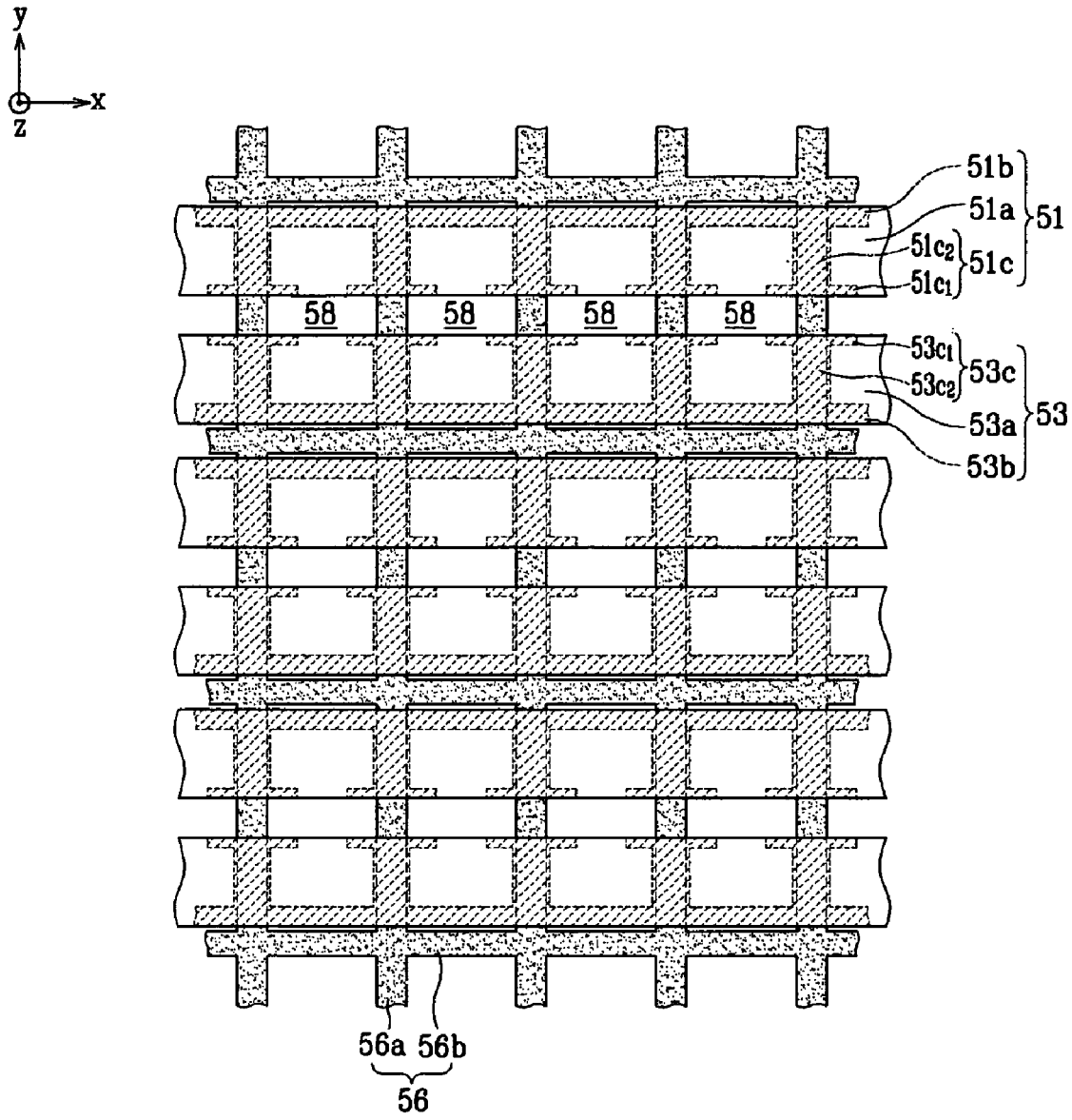
FIG. 7 is a partial plan view showing a plasma display panel according to a third embodiment of the invention.

FIG. 7 is a partial plan view showing a plasma display panel according to a third embodiment of the invention.

In the present embodiment, scan electrodes 51 and sustain electrodes 53 include expansion electrodes 51*a* and 53*a*, bus electrodes 51*b* and 53*b*, and auxiliary electrodes 51*c* and 53*c* extending from the bus electrodes 51*b* and 53*b* to front ends of the expansion electrodes 51*a* and 53*a*.

Referring to FIG. 7, the auxiliary electrodes 51*c* and 53*c* include first portions $\mathbf{51}c_1$ and $\mathbf{53}c_1$ formed over the discharge cells 58 adjacent to front ends of the expansion electrodes 51*a* and 53*a* in the second (x-) direction, and second portions $\mathbf{51}c_2$ and $\mathbf{53}c_2$ which extend from the first portions $\mathbf{51}c_1$ and $\mathbf{53}c_1$ in the first (y-) direction and which are connected to the bus electrodes 51*b* and 53*b*. In the illustrated embodiment, the bus electrodes 51*b* and 53*b* and the auxiliary electrodes 51*c* and 53*c* may be formed from different materials, or may be integrally formed of the same material.

In the present embodiment, each of the barrier ribs 56 has a first barrier rib member 56*a* and a second barrier rib member 56*b*. The second portions $\mathbf{51}c_2$ and $\mathbf{53}c_2$ of the auxiliary electrodes 51*c* and 53*c* are formed to substantially overlap the first barrier rib members 56*a*. In addition, line widths of the second portions $\mathbf{51}c_2$ and $\mathbf{53}c_2$ of the auxiliary electrodes 51*c* and 53*c* are greater than or equal to that of the first barrier rib member 56*a*.

In addition, in the first portions $\mathbf{51}c_1$ and $\mathbf{53}c_1$ of the auxiliary electrodes 51*c* and 53*c*, widths measured in the second (x-) direction may be greater than those measured in the first (y-) direction. Therefore, it is possible to increase overlap areas of the auxiliary electrodes 51*c* and 53*c* opposite to each other in each discharge cell 58. In the illustrated embodiment, the first portions 51$c_1$ and 53$c_1$ of the auxiliary electrodes 51$c$ and 53$c$ extend between discharge cells 58 that are adjacent in the second (x-) direction.

Since the auxiliary electrodes 51$c$ and 53$c$ extend to the front ends of the expansion electrodes 51$a$ and 53$a$ while being connected to the bus electrodes 51$b$ and 53$b$, the voltage applied to the bus electrodes 51$b$ and 53$b$ is effectively applied to the front ends of the expansion electrodes 51$a$ and 53$a$ because of relative high conductivity of the auxiliary electrodes 51$c$ and 53$c$. As a result, it is possible to reduce the discharge firing voltage.

Non-transparent auxiliary electrodes 51$c$ and 53$c$ are formed over the surface of the first barrier rib members 56$a$ corresponding to the portions where the scan electrodes 51 and the sustain electrodes 53 are formed, thereby improving the contrast.

The modification of the first embodiment may be applied to the second and third embodiments and is included within the scope of the invention.

Although the exemplary embodiments of the present invention have been described in detail hereinabove in connection with the accompanying drawings, it should be understood that the invention is not limited to the disclosed exemplary embodiments. It will be apparent to those skilled in the art that various modifications and changes can be made in the present invention without departing from the spirit or scope of the invention and the claims described below.

What is claimed is:

1. A plasma display panel comprising:

a first substrate and a second substrate disposed opposite to each other;

a plurality of barrier ribs disposed between the first substrate and the second substrate, wherein the barrier ribs define at least one discharge cell;

an address electrode formed along a first direction; and a plurality of display electrodes formed along a second direction, wherein the second direction intersects the first direction, wherein a pair of the display electrodes are disposed above the at least one discharge cell with a discharge gap interposed therebetween, and wherein each display electrode comprises:

a bus electrode extending along the second direction, an expansion electrode comprising a front end and a back end, wherein the back end is proximal to the bus electrode and the front end extends towards the other display electrode, and an auxiliary electrode disposed at or near the front end of the expansion electrode, wherein the auxiliary electrodes are formed at locations away from central portions of the at least one discharge cell wherein the plasma display panel comprises a plurality of discharge cells, each display electrode comprises a plurality of expansion electrodes, each expansion electrode is dimensioned and configured to correspond to the one discharge cell, and the auxiliary electrodes extend from the expansion electrodes away from the edges of the expansion electrodes in the second direction.

2. The plasma display panel of claim 1, wherein each display electrode comprises a plurality of auxiliary electrodes corresponding to the at least one discharge cell, wherein the auxiliary electrodes are located at or near the front end of the expansion electrode, the auxiliary electrodes are spaced apart from each other by a predetermined gap.

3. The plasma display panel of claim 1, wherein the auxiliary electrodes formed at or near the front ends of the pair of expansion electrodes above the at least one discharge cell oppose each other with the discharge gap interposed therebetween.

4. The plasma display panel of claim 1, wherein the auxiliary electrodes are positioned away from the bus electrodes.

5. The plasma display panel of claim 4, wherein the barrier ribs comprise barrier rib members formed in the first direction, and the auxiliary electrodes are formed adjacent to the barrier rib members.

6. The plasma display panel of claim 4, wherein the auxiliary electrodes are wider in the second direction than in the first direction.

7. The plasma display panel of claim 4, wherein each auxiliary electrode comprises a first portion formed along the front end of the expansion electrode in the second direction and a second portion extending from the first portion in the first direction.

8. The plasma display panel of claim 7, wherein the barrier ribs include barrier rib members formed in the first direction, and the second portions of the auxiliary electrodes substantially overlap the barrier rib members.

9. The plasma display panel of claim 8, wherein a width of the second portion of the auxiliary electrodes is equal to or greater than the width of the barrier rib members.

10. The plasma display panel of claim 7, wherein the first portion of each auxiliary electrode extends over two discharge cells, wherein the discharge cells are adjacent in the second direction.

11. The plasma display panel of claim 7, wherein the first portion of each auxiliary electrode is wider in the second direction than in the first direction.

12. The plasma display panel of claim 1, wherein each auxiliary electrode is directly connected to the bus electrode.

13. The plasma display panel of claim 12, wherein each auxiliary electrode comprises:

a first portion extending along the front end of the expansion electrode in the second direction, and a second portion which extends from the first portion in the first direction to the bus electrode.

14. The plasma display panel of claim 13, wherein the barrier ribs include barrier rib members formed in the first direction, and the second portion of each auxiliary electrode substantially overlap the barrier rib members.

15. The plasma display panel of claim 14, wherein a line width of the second portion of each auxiliary electrode is equal to or greater than a width of the barrier rib members.

16. The plasma display panel of claim 13, wherein the first portion of each auxiliary electrode extends over two discharge cells that are adjacent in the second direction.

17. The plasma display panel of claim 13, wherein the first portion of each auxiliary electrode is wider in the second direction than in the first direction.

18. The plasma display panel of claim 1, wherein the auxiliary electrodes and the bus electrodes comprise the same non-transparent, conductive material.

* * * * *